US006591761B2

(12) United States Patent
Degelman et al.

(10) Patent No.: US 6,591,761 B2
(45) Date of Patent: Jul. 15, 2003

(54) SEALING DOOR FOR A RAIL CAR

(75) Inventors: Paul Degelman, Regina (CA); Justin Tremblay, Regina (CA); Mark Sheridan, Elmhurst, IL (US)

(73) Assignees: General Electric Railcar Services Corporation, Chicago, IL (US); Degelman Industries Ltd. (CA)

( * ) Notice: Subject to any disclaimer, the term of this patent is extended or adjusted under 35 U.S.C. 154(b) by 0 days.

(21) Appl. No.: 09/828,485

(22) Filed: Apr. 9, 2001

(65) Prior Publication Data

US 2002/0033113 A1 Mar. 21, 2002

(30) Foreign Application Priority Data

Sep. 15, 2000 (CA) ..... 2319923

(51) Int. Cl.[7] ..... B61D 17/00

(52) U.S. Cl. ..... 105/378; 105/280; 105/282; 49/208

(58) Field of Search ..... 105/378, 238.1, 105/240, 258, 270, 280, 282, 286, 341; 49/208, 209, 211, 216, 218, 219, 221, 220

(56) References Cited

U.S. PATENT DOCUMENTS 3,720,020 A * 3/1973 Bollinger ..... 49/362
3,786,599 A * 1/1974 Galbarzyk et al. ..... 49/220
3,788,007 A 1/1974 Bailey
3,820,283 A 6/1974 Acerra et al.
3,978,618 A 9/1976 Malo
4,048,755 A * 9/1977 Wolak et al. ..... 49/130
4,064,810 A * 12/1977 Jenkins et al. ..... 105/378
4,091,570 A * 5/1978 Favrel ..... 49/118
4,098,022 A * 7/1978 Hesch ..... 49/209
4,114,935 A 9/1978 Malo
4,170,845 A 10/1979 Owen
4,296,956 A 10/1981 Colombo
4,319,429 A * 3/1982 Seitz ..... 49/220
4,608,777 A * 9/1986 Okamoto ..... 49/214
4,751,793 A * 6/1988 Jenkins et al. ..... 49/501
4,763,385 A 8/1988 Furch et al.
4,776,619 A 10/1988 Daugherty et al.
4,852,918 A 8/1989 Allen
5,056,835 A 10/1991 Johnson
5,142,823 A 9/1992 Brandenburg et al.
5,302,072 A 4/1994 Stauffer et al.
5,438,800 A * 8/1995 Porter ..... 49/209
6,226,924 B1 * 5/2001 Kuzub ..... 49/218
6,324,996 B1 * 12/2001 Saxton et al. ..... 105/355

* cited by examiner

*Primary Examiner*—S. Joseph Morano
*Assistant Examiner*—Frantz F. Jules
(74) *Attorney, Agent, or Firm*—McDermott, Will & Emery

(57) ABSTRACT

A sliding door is provided for use on a rail car having a floor and a side wall with an opening therein along one side of the floor. The opening is defined by a pair of side posts having respective front surface and a top and bottom sill. The front surfaces of the side posts define a sealing surface lying in a common vertical sealing plane with respective sealing surfaces of the top and bottom sill. The door is slidable on rails between an open position and a closed position across the opening. Pivotal mounting members mount the door on the rails for movement of the door in the closed position transversely to the rails and inwardly toward the opening from an outer sliding position to an inner sealed position. The door includes two side beams, a top beam and a bottom beam, each having a surface within a common plane for sealing with the respective sealing surface in the common vertical sealing plane of the opening.

12 Claims, 4 Drawing Sheets

SEALING DOOR FOR A RAIL CAR

The present invention relates to a sealable door for example for a rail car of a type which is arranged to tighten towards the rail car so that the door is sealed and locked.

BACKGROUND OF THE INVENTION

Freight box rail cars and the like are used to transport items across distances which vary in environment and topography. The doors on rail cars are generally mounted on rails which allow a door to slide horizontally to allow access to the inside of the rail car or to restrict access to the inside of the rail car. These doors are relatively large in stature and are made of metal since the loads carried within the rail cars can be large so the doors must be able to accept large items. The doors must also be durable due to the movement of the items within the rail car during transportation and due to the conditions surrounding the rail car during transportation. The conditions can consist of the elements such as rain, snow, wind and other weather conditions which can damage the items, and the conditions can consist of animals such as rodents entering the rail car which also can damage the items. A rail car door must also be able to be locked so that the items within the car are protected from theft and the like.

Some examples of doors of this type are found in U.S. Pat. Nos. 3,978,618 (Malo), 4,114,935 (Malo), 4,608,777 (Okamoto), 4,751,793 (Jenkins et al), 3,788,007 (Bailey), 4,091,570 (Favrel) and 5,142,823 (Brandenburg et al) which in general disclose a sliding door or the like arranged to enclose an area such as a rail car. The doors do not create a seal about an entrance so that water or the like may not enter, so that if a load such as paper is being hauled within the car, it is not protected and could be damaged. The doors have a locking device for locking the door either to close or to open an entrance. Another example of a sliding door of this type which does provide a seal is in U.S. Pat. No. 5,647,558 (Kober) which is arranged to provide a sealing door construction for a purpose built rail car. However this is not suitable for replacement type door on an existing sliding door type rail car.

Some examples of locking devices are shown in U.S. Pat. Nos. 4,852,918 (Allen), 4,763,385 (Furch et al), 3,820,283 (Acerra et al), 4,776,619 (Daugherty et al), 4,296,956 (Colombo) 5,056,835 (Johnson) and 5,302,072 (Stauffer et al).

SUMMARY OF THE INVENTION

It is one object of the present invention to provide an improved rail car door.

According to a first aspect of the invention there is provided a rail car construction comprising:

a floor;

a side wall along one side of the floor and standing upwardly from the floor;

an opening in the side wall defined by two side posts each at a respective side of the opening, a top beam extending across a top of the opening and a bottom sill defining an edge of the floor at the opening;

the side posts each forming a member with a front surface, a rear surface and a side surface, the side surface defining an inside side edge of the opening, the front surface defining a sealing surface lying in a vertical sealing plane of the opening;

the top beam including a sealing surface lying in the vertical sealing plane;

the bottom sill including a sealing surface lying in the vertical sealing plane;

a sliding door mounted on a longitudinal support at the opening extending parallel to a plane of the opening with the door movable from a closed position at the opening to an open position spaced along the longitudinal support from the opening;

the sliding door including pivotal mounting members mounting the door on the longitudinal support for movement of the door in a direction transverse to the longitudinal support so as to move the door in the closed position inwardly toward the opening from an outer sliding position to an inner sealed position to effect sealed closure within the opening;

the sliding door including an actuation system for effecting actuation of the pivotal mounting members;

the sliding door including two side beams, a top beam and a bottom beam which co-operate respectively with the side posts, top beam and bottom sill of the rail car respectively in a sealing action; and each of the side beams, top beam and bottom beam of the sliding door including a surface parallel to the sealing plane for sealing with the respective sealing surface by a compressible sealing member therebetween.

The sliding door preferably includes an interior surface extending to the beams and lying in a vertical plane spaced from the sealing plane toward the interior of the rail car which may be arranged to be coplanar with the rear surface of the posts in the inner sealed position. When the rear surfaces of the respective posts lie in a common plane with an inside surface of the side wall, the interior surface may also be arranged to be coplanar with an inside surface of the side wall of the rail car in the inner sealed position. The front surfaces of the respective posts in this arrangement are preferably located forwardly of the side wall.

The bottom sill preferably includes a down-turned flange defining the sealing surface in the sealing plane. A horizontal flange may be provided lying on the floor at the opening and wherein the down-turned flange preferably extends downwardly from an exterior edge of the horizontal flange.

The top beam may include a tubular beam portion and an angle iron attached to an underside of the tubular beam portion with a vertical flange portion of the angle iron defining the sealing surface in the sealing plane.

The longitudinal support preferably comprises top and bottom rails at the opening extending parallel to a plane of the opening. The pivotal mounting members are thus arranged to support the door on the respective top and bottom rails for movement transversely to the rails between the outer sliding position and the inner sealed position.

BRIEF DESCRIPTION OF THE DRAWINGS

Embodiments of the invention will now be described in conjunction with the accompanying drawings in which.

In the drawings like characters of reference indicate corresponding parts in the different figures.

DETAILED DESCRIPTION

Figure 1:
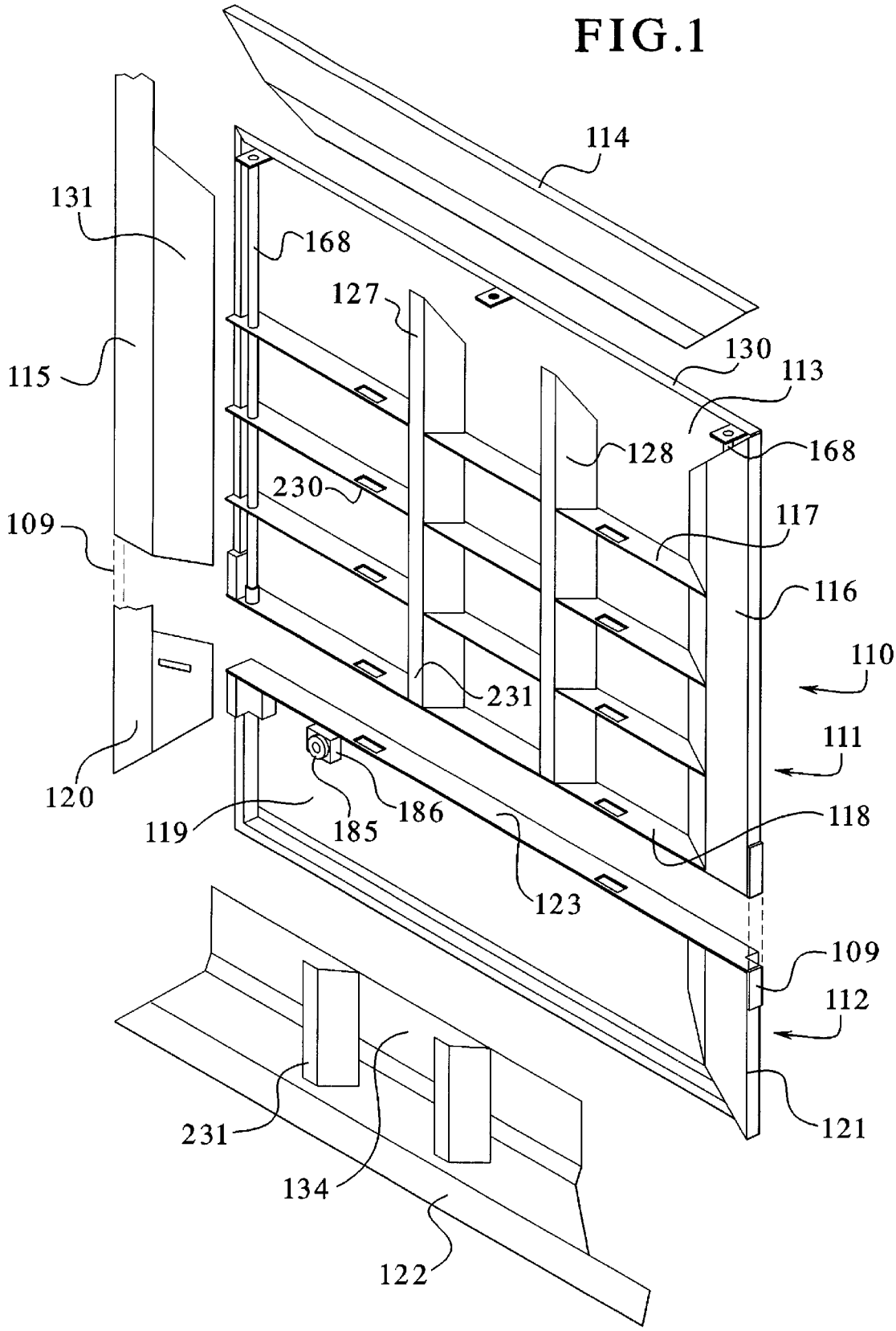
FIG. 1 is a partly exploded isometric view of a rail car door structure.

Referring to the accompanying drawings there is illustrated a rail car door generally indicated by reference numeral 110 for mounting on a rail car 150.

FIG. 1 shows a partly exploded view of the door construction. The door 110 comprises two door sections including an upper section 111 and a lower section 112. The door sections when combined to form the complete door provide dimensions which have a height equal to the height of the opening in the rail car as discussed hereinafter and a width also equal to the opening in the rail car allowing the door to be inserted as a plug into the opening as described in detail hereinafter.

The upper section 111 is formed from a back sheet 113, a top beam 114 and two side beams 115 and 116. The upper section further includes transverse stiffening members 117 in the form of flat horizontal plates arranged at spaced positions along the height of the section from the top beam 114 to a bottom one 118 of the horizontal plates at the bottom of the upper section.

Similarly the bottom section 112 has a back sheet 119 and two post sections 120 and 121 which co-operate with the post sections 115 and 116 to form a complete vertical beam extending along the full height of the door when the door is assembled. The bottom section further includes a bottom beam 122 similar to the top beam 114. The cross section of each of the beams around the periphery of the door is substantially identical as described in more detail hereinafter. The beams are mitred together so that the bottom beam 122 is mitred to the bottom of the beam sections 120 and 121 and similar to the top beam 114 is mitred to the top of the side beams 115 and 116.

The bottom section 112 further includes one or more horizontal stiffener members in the form of flat plates 123. The bottom section 112, as illustrated, has a single transfer stiffener plate 123 at its top edge.

In FIG. 1, the back sheet 113 of the upper section is formed as a single piece extending from the top edge of the top beam 114 to the bottom plate 118. The back sheet can be formed in plural pieces, but it will be appreciated that this difference provides little structural change. The upper and lower sections further include vertical stiffener members 127 and 128. These are formed as channel members with a front face lying in a front common plate with a front face of the beams and two side walls inclined rearwardly and outwardly from the front face to a rear edge at the back sheet 113. The vertical stiffeners 127 and 128 are formed in separate individual sections each extending from a horizontal member to the next horizontal member. Thus some of the sections connect from one of the beams to the next adjacent plate and similar sections are connected between the individual plates.

The back sheet 113 of the upper section and the back sheet 119 of the lower section each include an inturned side flange 130 extending from the edge forwardly of the back sheet into the interior of the structure for co-operating with the respective beam. Thus the flange extends along each side and along the top of the upper section 113 and extending along the bottom and sides of the bottom section 119.

The stiffener plates 117, 118 and 123 extend along the full length of the door structure from one side flange of the back sheet to the opposite side flange of the back sheet and also extend through the thickness of the door structure from the back sheet to the front plane of the door. Thus each of the side beams 115 and 116 has formed in an inner side wall a plurality of slots 131 so that the slots receive the stiffener plates allowing the inner surface to slide over the plates to the back sheet.

Figure 3:
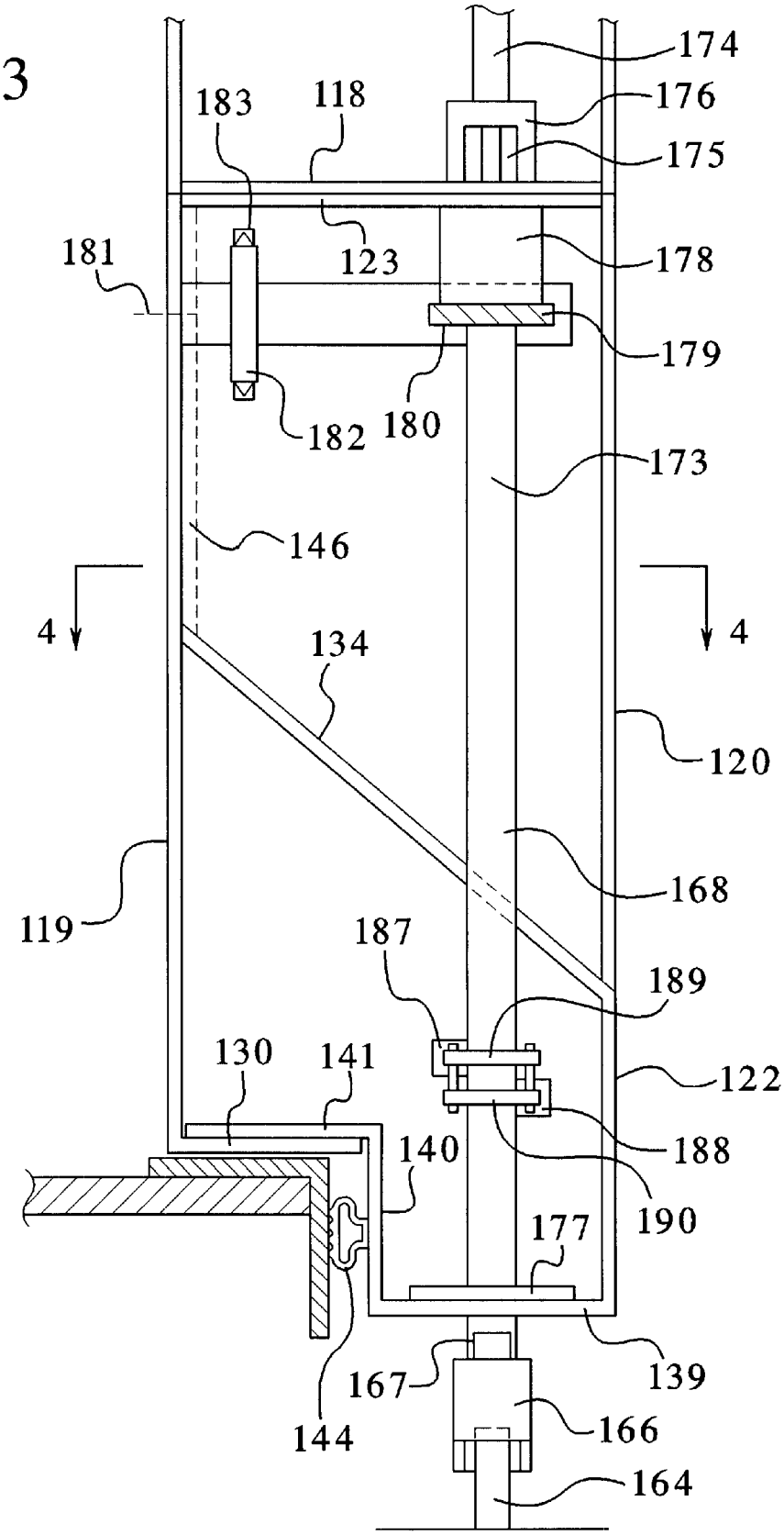
FIG. 3 is a vertical cross sectional view similar to that of FIG. 2 through the door of FIG. 1 showing only a bottom part of the door on an enlarged scale.
Figure 4:
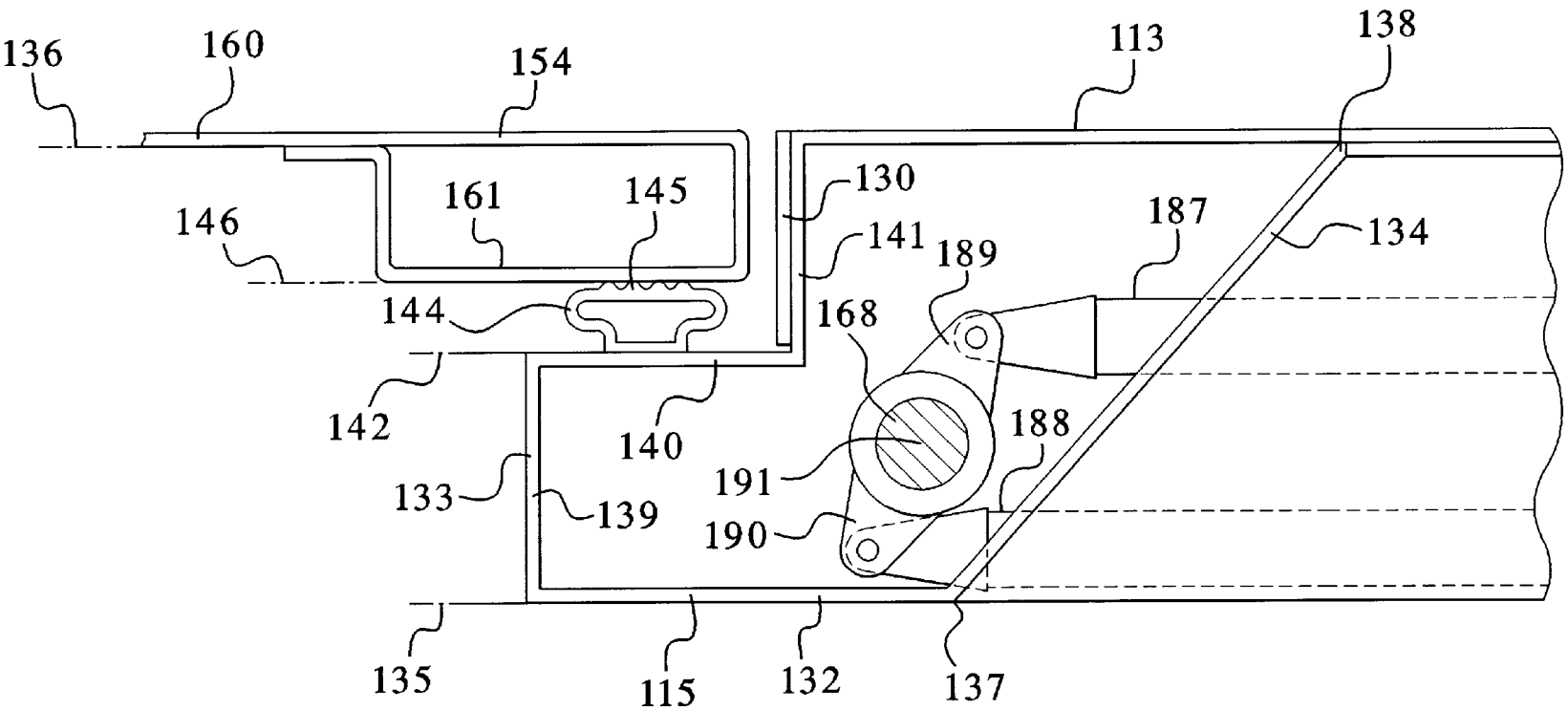
FIG. 4 is a vertical cross sectional view along the line 4—4 of FIG. 3.

The cross section of the beams is shown in more detail in FIGS. 3 and 4. In FIG. 3, the bottom beam 122 is shown and is substantially identical in cross section in the top beam 114. In FIG. 4, the side beam 115 is shown and is substantially identical to the side beam 116. It will be noted that the cross section of the side beams is substantially equal to the cross section of the top and bottom beams so that they can be connected at the mitred joint at the four corners.

The beam is thus formed generally into a channel shape with a front wall 132, an outer side wall 133 and an inner side wall 134. The front wall 132 lies in a common plane with the front edge of the stiffener plate, with the other front walls of the other beams and with the front wall of each of the vertical stiffener members 127, 128. The front plane 135 is thus spaced forwardly from a plane 136 of the rear wall 113 by a distance equal to the thickness of the door.

The inner wall 134 of each of the beams is sloped or inclined so that it commences at an outer edge 137 at the front wall and extends rearwardly and inwardly to a rear edge 138 at the rear plate 113. Thus each of the beams has the inner side wall converging inwardly with the angles being substantially identical to form a dished front section extending from the front plane 135 rearwardly to the rear plane 136. The stiffener members 127 and 128 have the side walls at an angle substantially equal to the angle of the inner side walls of the beams to provide an attractive appearance. The upper ends of the stiffener members 127 and 128 are also mitred so as to match the slope of the inner side wall of the top beam and a similar arrangement is provided at the bottom beam. The outer side wall 133 defines a rearwardly extending first portion 139 which extends to a transverse second portion 140 which in turn is connected to a rearward extending third portion 141. The length of the flange 130 of the rear plate is equal to the length of the third portion 141 so that one overlies the other allowing the rear plate 113 to be welded at the flange 130 to the outer side wall to form an interconnected structural member.

The transverse walls 140 all lie in a common sealing plane 142 parallel to the planes 135 and 136 and part way therebetween with all of the portions 140 of the beams lying in the same sealing plane 142. The width of the second wall portion 140 is sufficient to receive a compressible sealing strip 144. Various types of sealing strip are available commercially and the example shown comprises a hollow tube with a front face 145 for butting against a sealing plane 146 of the rail car as described hereinafter. Thus the three portions of the outer side wall define a stepped section where the outer portion at the wall portion 133 overlies the corresponding rail or post of the rail car and the inner section defined by the wall 141 lies inwardly of the edge of the opening of the rail car and projects through the opening into the interior of the rail car.

The upper section 111 of the door is arranged so that its height from the bottom plate 118 to the top wall portion 139 of the top beam 114 is equal to substantially the maximum shipping width or height allowing the upper section to be transported as a single piece using standard trailers. As the height of the rail car is often significantly greater than the normal shipping width of eight feet, the door is formed in two sections so that the lower piece is separated for shipping and transported separately for assembly at the rail car location.

In addition the lower section is fabricated to form a stronger section able to withstand and accommodate more vigorous action for example from the forks of fork lift trucks which often can impact the lower section when the car is being unloaded. For this reason, the lower beam sections 120 and 121 together with the bottom beam 122 are formed from thicker material than are the corresponding pieces of the upper section of the door. Yet further, at the upper edge of the inner wall 134 of a bottom beam 122 is provided an additional sheet 146 which lies against the rear sheet 119 of the bottom section. In this way the rear sheet is in effect formed from two sheets of material with the inner sheet 146 being thicker than the rear sheet 113 so as to provide more than double the strength of the rear sheet in the lower section of the door. In this way forks from a fork lift tending to impact the lower section of the door will slide over the sloped inner wall 134 onto the rear sheet which is sufficiently strengthened by the double thickness and thicker material to withstand significant impact forces from the fork.

The upper and lower sections are connected together by bolting the plate 118 to the plate 123 and by straps 109 which are attached to the sides of the side beams 115 and 116 and bridge the connection to provide rigidity to the assembled construction.

Figure 2:
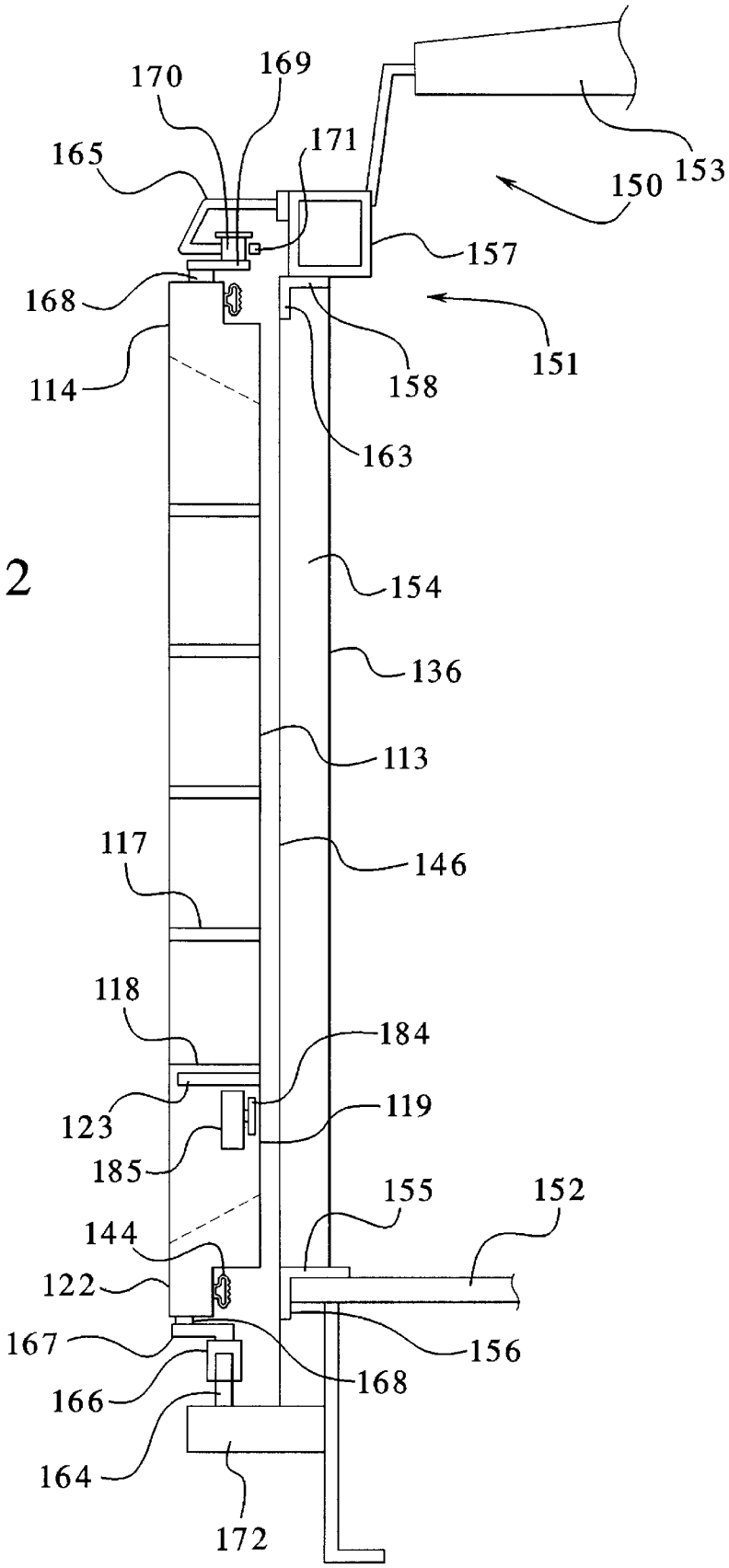
FIG. 2 is a vertical cross sectional view through the door of FIG. 1 installed in place on a rail car and in a closed but sliding position.

In FIG. 2, the door 110 is shown mounted on the rail car 150 at an opening 151. The construction of the rail car is well known and the present invention is primarily concerned with a door suitable for replacement of existing simple sliding doors without a plugging action so that the car can be sealed against weather penetration simply by replacing the sliding door and its mounting arrangement with the modified sliding and plugging door and its new mounting arrangement as shown particularly in FIG. 2. The rail car includes a floor 152 and a roof structure 153. The frame structure and wheel arrangement are not shown since these are well known to one skilled in the art. The opening 151 is defined by a pair of side posts 154. At the bottom the opening is defined by a sill member 155 which overlies an edge of the floor and defines a vertical flange 156 covering the floor edge. At the top the opening is defined by a horizontal header 157 to which is added a horizontal header edge member 158 extending along the underside of the header and defining the upper edge of the opening.

Specific arrangements of the posts, sill and header can vary for different types and arrangement of rail car. However, in all cases the header member 158, the sill member 155 and the posts are arranged to define the sealing plane 146 at the front surface of the posts and the front surfaces of the sill and header. All of these surfaces are arranged to lie in the common plane so that they can seal against the sealing strip 144 carried on the second portion 140 of the sidewall of the door.

As shown in FIG. 4, the inner sheet 113 in the sealed position is arranged to lie in a common plane with the inside surface of the posts 154 which is in a common plane with the side wall 160 of the rail car. The front face 161 of the post is therefore forward of the plane 136. The sill is thus arranged so that the flange 156 lies in a common plane with the front edge 161 of the posts and similarly the header edge 158 includes a downwardly depending flange 163 which lies in the same common plane.

In the sealed position shown in FIG. 4, the sealing strip is compressed to provide a sealing action and the inside portion of the door projects into the interior of the opening so that the back sheet 113 lies in a plane 136. In the unsealed position shown in FIG. 2, the door is backed out of the opening so that the back sheet 113 is clear of the front edge of the post allowing the door to slide longitudinally of the side of the rail car from a position at the opening to a position spaced beyond the opening to allow loading access through the opening.

The door is, in order to provide this movement, carried on a bottom rail 164 and a top guide 165 which are arranged in a sliding plane along the rail car outwardly of the opening allowing sliding action of the door. The door moves inwardly and outwardly relative to the rail and the guide by a cam and shaft drive arrangement by which rotation of the shaft causes a cam movement at the top and bottom of the door to force the door inwardly and outwardly between the sealed and unsealed positions.

The rail 164 supports a carriage 166 for rolling along the rail and that carriage is connected to the door by a cam 167 connected to the bottom end of a shaft 168. The same shaft at its upper end carries a cam 169 with a roller 170 carried in a slot 171 in the guide 165. The guide 165 thus includes a horizontal upper portion together with a parallel lower portion within which the slot 171 is provided so that the roller 170 projects through the slot in the lower portion and is protected underneath the upper portion. The guide 165 is mounted on a bracket attached to the header 157.

The rail 164 is carried on a suitable horizontal support 172 underneath the opening and attached by suitable frame elements to the side of the car.

As illustrated in the accompanying figures, there are two shafts 168 each arranged within a respective one of the side beams 115 and 116 of the door. Each shaft has at its upper end a respective one of the cams 169 and has at its lower end a respective one of the cams 167.

Each shaft 168 is divided into two portions including a lower portion 173 within the lower portion of the door and an upper portion 174 within the upper portion of the door. For assembly, the lower portion 173 includes a stub shaft portion 175 projecting outwardly above the plate 123 which is non circular in cross section so as to co-operate with a sleeve type receptacle 176 which has a corresponding cross sectional shape to allow communication of rotation from the lower portion to the upper portion for common movement of the upper and lower cams. The shaft is mounted within a bearing collar at each plate 117 and these are mounted within a separate bearing plate 177 at the bottom wall 139 and within a bearing housing 178 at the plate 123 of the bottom section of the door. At the bearing 178 is provided a wheel 179 of a worm and wheel drive arrangement for driving rotation of one of the shafts 168. The wheel 179 co-operates with a worm 180 supported for rotation about an axis 181 and carried on the back sheet 119 at a position just below the top plate 123. The worm 180 is driven by a sprocket 182 carried on the worm and driven by a chain 183. The chain 183 is driven by a sprocket 184 carried on the shaft of a handle 185 mounted on the bottom portion of the door just under the plate 123 as shown in FIG. 1 adjacent the side post 115 but outside the inner side wall of the side post 115. The handle comprises a rotatable hand wheel which can rotate about a horizontal axis parallel to the axis 181 and the chain is located within a suitable chain housing 186 and communicates through an opening 187 in the side wall of the post portion 120 to drive the sprocket 182 and the worm 180.

Rotation of the left hand shaft 168 is transferred to the right hand shaft 168 by a pair of drive rods best shown in FIG. 4. Thus there is a drive rod 187 behind the shafts 168 and extending from one shaft to the other shaft and a second rod 188 symmetrical to the first and arranged in front of the shafts 168. Each of the drive rods is connected to the respective shaft at its respective ends by a lug 189, 190 projecting outwardly from the shaft the rods 187 and 188 are pivotally connected to the lugs 189, 190 so that the rods can move substantially longitudinally along the bottom beam 122 within that beam as shown in FIG. 3 while the lugs rotate around the axis 191 of the shaft. The rods are arranged so that they allow rotation of the shaft 168 through an angle limited to 90° until the binding action of the rod end on the shaft stops further movement. The rotation of the shaft through 90° therefore causes the cams at the end of the shaft to rotate through the same angle thus moving from a position inline with the bottom edge of the door to a position projecting outwardly at right angles so as to effect the movement from the unsealed to the sealed position of the door.

The hand wheel drive arrangement is only one example of a suitable drive mechanism for communicating drive through the shafts. Alternative mechanisms may be provided for powered drive action to the shafts. Other styles of manually operable handle can also be provided in the form of a hand crank or the like. The chain coupling can provide a mechanical advantage so that the hand wheel or hand crank can rotate a number of turns while the cams move through the 90°.

With the basic drive to the shaft 168 being effected by a worm and wheel arrangement, there is an advantage in that there is no back pressure against the worm by forces on the door tending to rotate the cams. Thus when the doors are moved to the sealed position, forces tending to move the door to the unsealed position are communicated into the shafts 168 but these forces are not communicated through the worm and wheel arrangement back to the handle with the possibility of the drive to the closure being reversed and allowing the door to move to the unsealed position.

The handle height is arranged just under the top plate of the bottom portion of the door since this height is located conveniently to allow a person standing on a platform at a height equal to the bottom of the door to reach down and operate the handle and in addition a person standing on the ground alongside the rail car can also reach up and operate the handle. A single handle therefore can be provided which allows operation of the door from the sealed to the unsealed position from either positions without the necessity for stepping up onto a step or the like and without the necessity for providing separate handles for the separate locations.

As shown in FIG. 1, the plates 117 have oval or elongate slots or holes 230 formed therein adjacent the front edge to act as handgrips to allow an operator to grasp the door and manually slide the door from the closed position along the rail car to the open position. Similarly the front face of each of the vertical reinforcing members 127 and 128 includes similar slots 231 extending upwardly along the front face to act again as hand grips for an operator.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A rail car construction comprising:

a floor;

a side wall along one side of the floor and standing upwardly from the floor;

an opening in the side wall defined by two side posts each at a respective side of the opening, a top beam extending across a top of the opening and a bottom sill defining an edge of the floor at the opening;

the side posts each forming a member with a front surface, a rear surface and a side surface, the side surface of each side post defining an inside side edge of the opening, the front surface of each side post defining a sealing surface lying in a vertical sealing plane of the opening;

the top beam including a sealing surface lying in the vertical sealing plane;

the bottom sill including a sealing surface lying in the vertical sealing plane;

a sliding door mounted on a longitudinal support at the opening extending parallel to a plane of the opening with the door movable from a closed position at the opening to an open position spaced along the longitudinal support from the opening;

the sliding door including pivotal mounting members mounting the door on the longitudinal support for movement of the door in a direction transverse to the longitudinal support so as to move the door in the closed position inwardly toward the opening from an outer sliding position to an inner sealed position to effect sealed closure within the opening;

the sliding door including an actuation system for effecting actuation of the pivotal mounting members;

the sliding door including two side beams, a top beam and a bottom beam which cooperate respectively with the side posts, top beam and bottom sill of the rail car respectively in a sealing action; and each of the side beams, top beam and bottom beam of the sliding door including a surface parallel to the sealing plane for sealing with the respective sealing surface by a compressible sealing member therebetween.

2. The rail car according to claim 1 wherein the sliding door includes an interior surface extending to the beams and lying in a vertical plane spaced from the sealing plane toward the interior of the rail car which is arranged to be coplanar with the rear surface of the posts in the inner sealed position.

3. The rail car according to claim 1 wherein the sliding door includes an interior surface extending to the beams and lying in a vertical plane spaced from the sealing plane toward the interior of the rail car which is arranged to be coplanar with an inside surface of the side wall of the rail car in the inner sealed position.

4. The rail car according to claim 1 wherein the bottom sill includes a down-turned flange defining the sealing surface in the sealing plane.

5. The rail car according to claim 4 wherein the bottom sill includes a horizontal flange lying on the floor at the opening and wherein the down-turned flange extends downwardly from an exterior edge of the horizontal flange.

6. The rail car according to claim 1 wherein the top beam that defines the opening includes a tubular beam portion and an angle iron attached to an underside of the tubular beam portion with a vertical flange portion of the angle iron defining the sealing surface in the sealing plane.

7. The rail car according to claim 1 wherein the rear surfaces of the respective posts lie in a common plane with an inside surface of the side wall.

8. The rail car according to claim 1 wherein the front surfaces of the respective posts are located forwardly of the side wall.

9. The rail car according to claim 1 wherein the longitudinal support comprises top and bottom rails at the opening extending parallel to a plane of the opening and wherein the pivotal mounting members support the door on the respective top and bottom rails for movement transversely to the rails between the outer sliding position and the inner sealed position.

10. A rail car construction comprising:

a floor;

a side wall along one side of the floor and standing upwardly from the floor;

an opening in the side wall defined by two side posts each at a respective side of the opening, a top beam extending across a top of the opening and a bottom sill defining an edge of the floor at the opening;

the side posts each forming a member with a front surface, a rear surface and a side surface, the side surface defining an inside side edge of the opening, the front surface defining a sealing surface lying in a vertical sealing plane of the opening;

the top beam including a sealing surface lying in the vertical sealing plane;

the bottom sill including a down-turned flange defining a sealing surface lying in the vertical sealing plane;

a sliding door mounted on a longitudinal support at the opening extending parallel to a plane of the opening with the door movable from a closed position at the opening to an open position spaced along the longitudinal support from the opening;

the sliding door including pivotal mounting members mounting the door on the longitudinal support for movement of the door in a direction transverse to the longitudinal support so as to move the door in the closed position inwardly toward the opening from an outer sliding position to an inner sealed position to effect sealed closure within the opening;

the sliding door including an actuation system for effecting actuation of the pivotal mounting members;

the sliding door including two side beams, a top beam and a bottom beam which cooperate respectively with the side posts, top beam and bottom sill of the rail car respectively in a sealing action; and each of the side beams, top beam and bottom beam of the sliding door including a surface parallel to the sealing plane for sealing with the respective sealing surface by a compressible sealing member therebetween.

11. The rail car according to claim 10 wherein the bottom sill includes a horizontal flange lying on the floor at the opening and wherein the down-turned flange extends downwardly from an exterior edge of the horizontal flange.

12. A rail car construction comprising:

a floor;

a side wall along one side of the floor and standing upwardly from the floor;

an opening in the side wall defined by two side posts each at a respective side of the opening, a top beam extending across a top of the opening and a bottom sill defining an edge of the floor at the opening;

the side posts each forming a member with a front surface, a rear surface and a side surface, the side surface defining an inside side edge of the opening, the front surface defining a sealing surface lying in a vertical sealing plane of the opening;

the top beam including a tubular beam portion and an angle iron attached to an underside of the tubular beam portion with a vertical flange portion of the angle iron defining a sealing surface lying in the vertical sealing plane;

the bottom sill including a sealing surface lying in the vertical sealing plane;

a sliding door mounted on a longitudinal support at the opening extending parallel to a plane of the opening with the door movable from a closed position at the opening to an open position spaced along the longitudinal support from the opening;

the sliding door including pivotal mounting members mounting the door on the longitudinal support for movement of the door in a direction transverse to the longitudinal support so as to move the door in the closed position inwardly toward the opening from an outer sliding position to an inner sealed position to effect sealed closure within the opening;

the sliding door including an actuation system for effecting actuation of the pivotal mounting members;

the sliding door including two side beams, a top beam and a bottom beam which cooperate respectively with the side posts, top beam and bottom sill of the rail car respectively in a sealing action; and each of the side beams, top beam and bottom beam of the sliding door including a surface parallel to the sealing plane for sealing with the respective sealing surface by a compressible sealing member therebetween.

* * * * *